United States Patent [19]

Deckert

[11] Patent Number: 4,722,266

[45] Date of Patent: Feb. 2, 1988

[54] REGISTER AIR-FLOW BOOSTING DEVICE

[75] Inventor: Dennis D. Deckert, Orlando, Fla.

[73] Assignee: Air-Tronex, Inc., Orlando, Fla.

[21] Appl. No.: 817,682

[22] Filed: Jan. 10, 1986

[51] Int. Cl.[4] ..... F24F 7/06

[52] U.S. Cl. ..... 98/103; 98/39.1

[58] Field of Search ..... 98/39.1, 101, 103, 40.19; 236/49

[56] References Cited

U.S. PATENT DOCUMENTS 1,426,900 8/1922 Neal ..... 98/103 X
2,448,671 9/1948 Hora ..... 98/94.1
4,576,331 3/1986 Harwell ..... 98/103 X
4,589,331 5/1986 Villamagna et al. ..... 98/103 X

*Primary Examiner*—Harold Joyce
*Attorney, Agent, or Firm*—Edward M. Livingston

[57] ABSTRACT

A device designed to fit externally over existing air-registers, the device containing a high-volume induction driven fan, which simultaneously pushes and pulls air through air-ducts and into a room to provide improved temperature distribution throughout a house, thereby reducing energy costs and increasing the effectiveness of heating and air conditioning systems.

4 Claims, 4 Drawing Figures

REGISTER AIR-FLOW BOOSTING DEVICE

BACKGROUND OF THE INVENTION

This invention relates to air-flow boosting devices, particularly those designed to increase air-flow from household and commercial registers over heating and air-conditioning ducts.

In the past, obtaining an even distribution of air from heating and air-conditioning unit (for convenience, hereinafter referred to as "HACU") in the ordinary household or in commercial buildings has been very difficult, if not nearly impossible, due to inadequate HACU or defective ducting.

This uneven distribution is especially noticeable the greater the distance of the duct from the HACU, which results in less air-flow from the duct registers. Thus, the air-flow coming from those distant registers must be increased.

Prior attempts to solve this problem have been unsuccessful because the devices in the prior art do not provide enough boost in air flow to accomplish the necessary equalization of temperatures within a building.

U.S. Pat. No. 3,099,201, dated Jan. 30, 1963 by Gottlieb, discloses a device which replaces a register entirely and fits into the air-duct itself. The Gottlieb device apparently disregards the fact that registers are not universally sized and, therefore, the device does not fit all registers. Related to this is that in order to install this device in the register, extra installation is required. A further major problem with the Gottlieb device is that since the air-flow area remains the size of the register it is replacing, the device does not provide a sufficient volume of cooled or heated air at the register for the fan to pull and push air into the room.

U.S. Pat. No. 2,972,941, Feb. 20, 1961 by Bennett, is very similar to the Gottlieb patent in that it fits inside the register, (rather than externally as the instant invention), and thus, has the same inherent problems as the Gottlieb patent.

U.S. Pat. No. 2,043,934, June 9, 1936, by Spear, is not designed for registers, but fits within large heating ducts. Except for the fans, there is no resemblance whatever to the instant invention.

Another patent, U.S. Pat. No. 1,886,841, Nov. 8, 1932, by Seales, like the Spear patent, is designed to fit inside the furnace pipes and not over the air-registers. It further appears to be complex to install and use.

A fifth patent, U.S. Pat. No. 1,875,683, Sept. 6, 1932, by Waterbury, is designed to fit internally in the register. The related patent by Waterbury, U.S. Pat. No. 1,743,994, dated Jan. 14, 1930, is also designed to fit internally, inside the register. Unfortunately, due to inadequacies in design, both of the Waterbury patents still encounter the major problem of the others, that is, each fails to produce sufficient cooled or heated air in large air-flow areas to provide even distribution of temperatures, such as in a building.

Thus, all the devices in the prior art, are defective in that they fail to increase the air-flow out of the registers adequately to accomplish the purpose of the instant invention.

The numerous above mentioned problems with the devices in the prior art, are solved by the instant invention. The instant invention consists of a device which is completely self-contained and fits externally over the ordinary register and is, therefore, easy to install. Moreover, the instant device increases or boosts air-flow substantially by providing an induction driven fan which blows air through a circular portion smaller than the register's size. The design in the instant device enables it not only to boost the air for better circulation into a room, but also to draw air through the air ducts coming from the HACU. Moreover, as it draws air through the air ducts, the air-flow to rooms to which conjoining ducts lead also improves. This overall improvement in air-flow results in a more rapid adjustment of room temperatures to the desired temperature, thereby lessening operating time of the HACU. In summary, the benefits provided by this invention create quite a substantial savings in energy costs.

SUMMARY OF THE INVENTION

The primary object of this invention is to provide a device which increases the effectiveness of HACUS in the ordinary household and in commercial buildings.

A corollary object of this invention is to provide a device which can reduce energy costs substantially.

A further object of this invention, is to provide a device which is easy to install and remove and which can fit in almost any location.

An even further object of this devise is to lessen operating time of the HACU thereby increasing life of the HACU.

Another object of the invention is to reduce the need to manipulate thermostats to obtain desired air temperature in various rooms of a home.

The instant invention accomplishes these and other objects by providing a device which is self-contained and fits easily over ordinary air-registers. Said device contains a fan which, aided by a designed reduction in air-outlet area at the register, increases the draw on the duct and simultaneously increases the flow in conjoining duct branches, allowing the HACU to be used to its fullest. Thus, energy costs should be reduced by lessening the time the HACU needs to run and even in keeping the thermostat at a higher or lower temperature setting, depending on whether you are cooling or heating an area.

The invention is easy to install because it fits externally over the existing air register and does not require the register to be removed or inserted into the ducts. A gasket made of foam rubber around the perimeter of the invention keeps the devise from drawing air and reduces vibration and noise.

DESCRIPTION OF THE PREFERRED EMBODIMENTS

Figure 1:
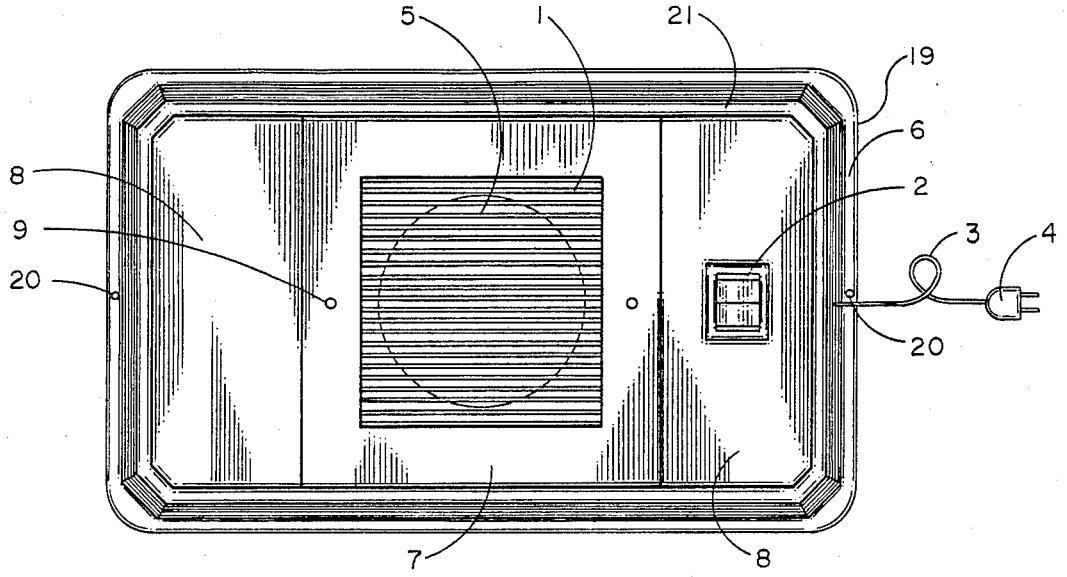
FIG. 1 is a front view of the invention.

Referring now in detail to the drawings, FIG. 1 shows the front view of the invention. The outside layer or cover of the device 19 can be made of lightweight plastic, aluminum, or other metal. Screw holes 20 are placed anywhere along the side margin 6 of the cover 19 for installation of the device on the outside of existing registers. The protruding or elevated portion of the outside cover 21 has an aesthetically pleasing panel section 8 of simulated woodgrain or paint. This protruding portion 21 also contains an on-off switch or variable speed control switch designated by 2, used to supply electrical power through the wire 3 to the plug 4 from the standard household socket.

The grill section 7, which can also be made of plastic or aluminum, is attached to the cover 19 by rivets 9 or can be manufactured by injection molding as part of the outside cover 21. This grill section 7 contains a square innerportion having louvres 1, used to direct the flow of air from the device. The circular area 5 within this louvred area is the area through which the fan pushes air outwardly into the room.

Figure 2:
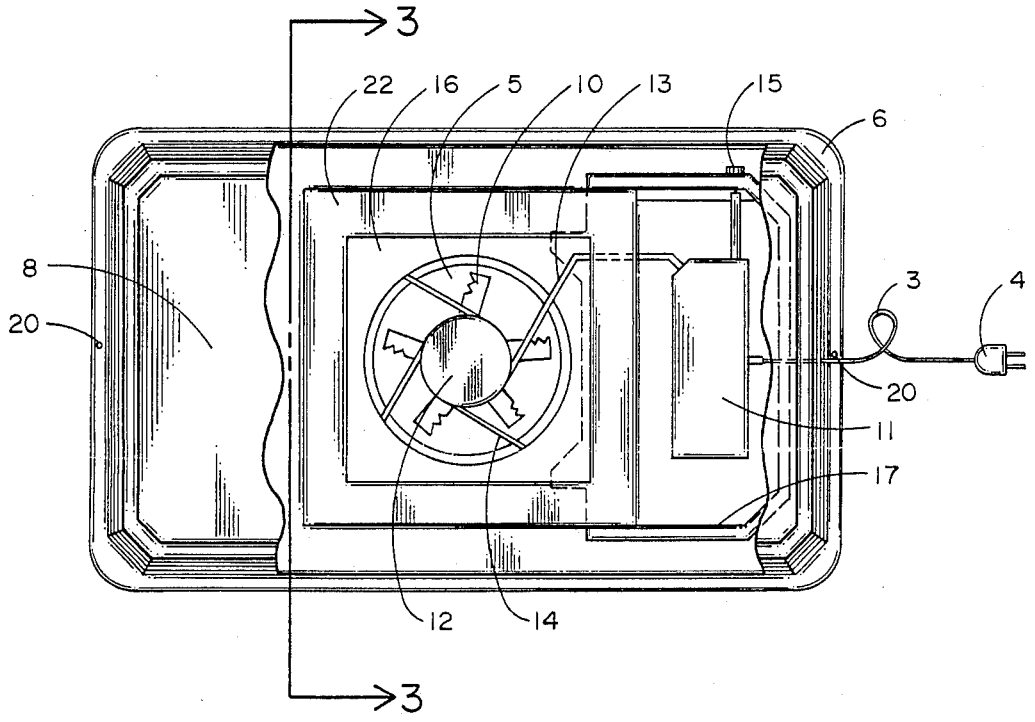
FIG. 2 shows a partial, cut-away front view of the device.
Figure 3:
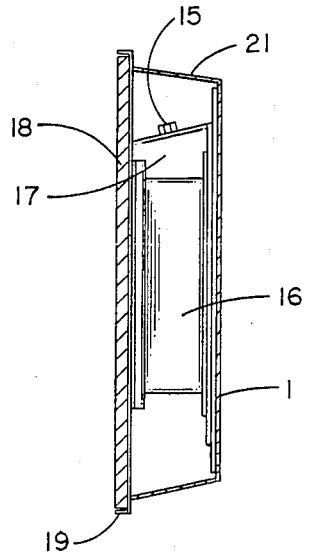
FIG. 3 is a cross-sectional side view along the lines of line 3—3 of FIG. 2.
Figure 4:
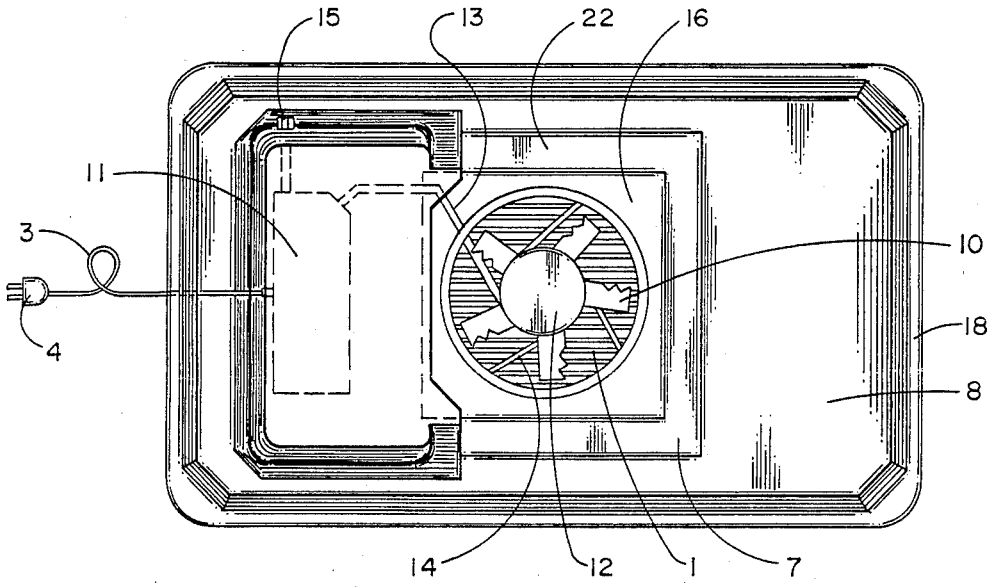
FIG. 4 is a rear view of the invention.

FIGS. 2 through 4 of the drawings illustrate the internal parts of the invention. The fan housing 16, which can be made of molded plastic, contains the circular openings depicted by 5 in all figures. The fan blades 10 are attached to an induction motor 12, which in turn is attached to the fan housing 16 by plastic or four metal struts such as that depicted by 14. One strut 13 contains the electrical wire for supplying power to the motor 12. Said wire runs from the strut 13 through a switching mechanism 11. Said switching mechanism 11 acts in conjunction with the on-off switch or variable control switch 2 on the outside of the device to switch the device on and off. The switching mechanism 11 also contains a resistor which enables the power and speed to be varied by turning the knob 15.

The fan housing 16 is attached to a holder 22 which is then glued or bolted to the back or the side of the protruding portion 21. A protective cover 17, which also can be made of plastic, covers the switching mechanism 11. To reduce vibrations, noise and possible damage to the register or wall during installation, a foam rubber felt pad 18 is contained in the outer margins 6 as shown in FIG. 3. In addition to reducing noise and vibrations, the pad 18 forms an air-tight barrier around the perimeter so that external air from the room is not drawn into the unit and mixed with air from the HACU which would partially defeat a major purpose of the invention.

The final drawing in FIG. 4 depicts the rear view of the invention. Inasmuch as all parts showing in FIG. 4 have been described already, no further discussion is necessary.

Having described the components and making of the invention in detail now, it is necessary to discuss the operation of this device. The device is placed over an existing register in the ceiling, on the wall or in the floor. The device is then supplied with electrical current by inserting the plug 4 into a nearby wall socket. The onoff or variable control switch 2 can then be positioned to operate the fan which simultaneously pulls and pushes air from the HACU through the ducts into the room.

Thus, in the manner described herein, this invention offers numerous advantages, the primary one being that it increases the efficiency of current HACUs in homes and commercial buildings thereby reducing energy costs.

Other embodiments of the device can include, without any major modifications, an on-off switch which will also vary the speed of the fan and a unit which activates when the HACU activates.

While the preferred embodiments of the invention and the various modes of the utilization of same have been described in detail hereinabove, it is understood that these and various modifications may be made from the specific details described herein without departing fromn the spirit and scope of the invention.

Having thus described my invention, I claim the following:

1. A device for boosting air flow from heating and air conditioning registers comprised of:

an exterior cover containing side margins having a foam rubber backing or gasket with means of installation so as to form a seal between the device and the surface to which the device is attached; elevated or protruding portions in the exterior cover containing two panels or cavities, one of said panels which may have an on-off/variable control switch or other assessories, such as a smoke alarm or air freshener; a central grill section between the two panels containing louvres for directing and diffusing air flow through a central circular portion in the grill section; a housing attached to the interior of said grill section; a fan in said housing which is driven by an induction motor at the center of the blades; a switching mechanism which acts in conjunction with the on-off switch for varying the power supply through the fan; and an electrical wire and plug for providing electrical current to the device.

2. The device of claim 1, with a variable power control for adjusting the speed of the fan.

3. An air-flow boosting device which fits over heating and air conditioning registers, comprising:

an exterior cover containing side margins having foam rubber backing or gasket with means of installation so as to form a seal between the device and the surface to which the device is attached; elevated or protruding portions in the exterior cover containing two panels, one of said panels having an on-off/variable control switch; a central grill section between the two panels containing louvres for directing and diffusing air flow through a central circular portion in the grill section; a housing attached to the interior of said grill section; a fan in said housing which is driven by an induction motor at the center of the blades; a switching mechanism which acts in conjunction with the on-off switch for varying the power supply through the fan; and an electrical wire and plug for providing electrical current to the device.

4. The device of claim 3, with a variable power control for adjusting the speed of the fan.

* * * * *